US006895702B1

(12) United States Patent
Colbert

(10) Patent No.: US 6,895,702 B1
(45) Date of Patent: May 24, 2005

(54) SCENTED CALENDAR

(76) Inventor: Darrell R. Colbert, 3902 Congress, Beaumont, TX (US) 77705

( * ) Notice: Subject to any disclaimer, the term of this patent is extended or adjusted under 35 U.S.C. 154(b) by 0 days.

(21) Appl. No.: 09/557,928

(22) Filed: Apr. 22, 2000

Related U.S. Application Data

(60) Provisional application No. 60/132,206, filed on May 3, 1999, and provisional application No. 60/130,454, filed on Apr. 22, 1999.

(51) Int. Cl.[7] ..... G09D 3/00
(52) U.S. Cl. ..... 40/107; 40/119; 283/2
(58) Field of Search ..... 40/107, 119, 122, 40/775; 283/2

(56) References Cited

U.S. PATENT DOCUMENTS 2,213,920 A * 9/1940 Murray ..... 218/15
4,326,359 A * 4/1982 Tabacchi ..... 47/58
4,905,112 A * 2/1990 Rhodes ..... 360/132
4,925,029 A * 5/1990 Friedman et al. ..... 206/473
5,492,675 A * 2/1996 Brizard ..... 422/122
5,992,889 A * 11/1999 Barnett et al. ..... 283/56
6,024,386 A * 2/2000 Spector ..... 283/117
6,213,303 B1 * 4/2001 Harris et al. ..... 206/581

FOREIGN PATENT DOCUMENTS

JP 2-142061 U * 2/1990
JP 8-80691 * 3/1996

* cited by examiner

*Primary Examiner*—Douglas C. Butler
*Assistant Examiner*—Bradley King

(57) ABSTRACT

The invention is a scented calendar. Preferably, the calendar is a monthly calendar, so that users will be reminded to replace or replenish the scent when the month is changed. More preferably, the calendar depicts a new image each month, and the scent is associated with what the image depicts.

8 Claims, 5 Drawing Sheets

10
4
Take time to meditate and relax the mind, for beauty is all around. Take the nature trail and smell the roses.

2
"Princess de Monaco Rose"
8
JANUARY 2000
SUNDAY MONDAY TUESDAY WEDNESDAY THURSDAY FRIDAY SATURDAY
1 New Year's Day
3 New Year's Bank Holiday (Scotland)
4
5
6
7
8
9
10
11
12
13
14
15
16
17 Martin Luther King, Jr. Day (US)
18
19
20
21
22
23
24
25
26 Australia Day (Australia)
27
28
29
30
31
6
10

SCENTED CALENDAR

CROSS REFERENCES TO RELATED APPLICATIONS

This application claims the benefit of U.S. Provisional Application No. 60/130,454 filed Apr. 22, 1999 and 60/132,206 filed May 3, 1999, the disclosures of which are herein incorporated by reference.

BACKGROUND OF THE INVENTION

1. Field of the Invention

In one aspect, this invention relates generally to air fresheners or room scents. In another aspect, this invention relates to a dispenser for an air freshener or room scent.

2. Background Art and Objects of the Invention

Many types of air fresheners or room scents are available. These items generally function by release of scent from a freshening element, and, in general only have limited lives. They periodically need maintenance or replacement of the freshening element for optimal function.

Because the effectiveness of such air fresheners or room scents decreases slowly over several days or weeks, consumers are generally not acutely aware that their effectiveness has decreased. As a consequence, the required maintenance or replacement cycle is generally not closely adhered to.

A way to draw attention to a need to maintain or replace the freshening element would be very desirable.

Although not generally recognized as such, scents are powerful art forms. The scents of perfumes, flowers, food stuffs, and various outdoor scents, for example, can stir powerful emotions and memories and profoundly affect one's state of mind. A new technique for bringing together visual images and their associated scents would be well received.

It is an object of this invention to bring together the use of scents and visual images in a utilitarian package.

SUMMARY OF THE INVENTION

In accordance with the invention, there is provided a scented calendar. Preferably, the calendar is a monthly calendar, so that users will be reminded to replace or replenish the scent when the month is changed. More preferably, the calendar depicts a new image each month, and the scent is associated with what the image depicts.

DETAILED DESCRIPTION OF THE INVENTION

Figure 1:
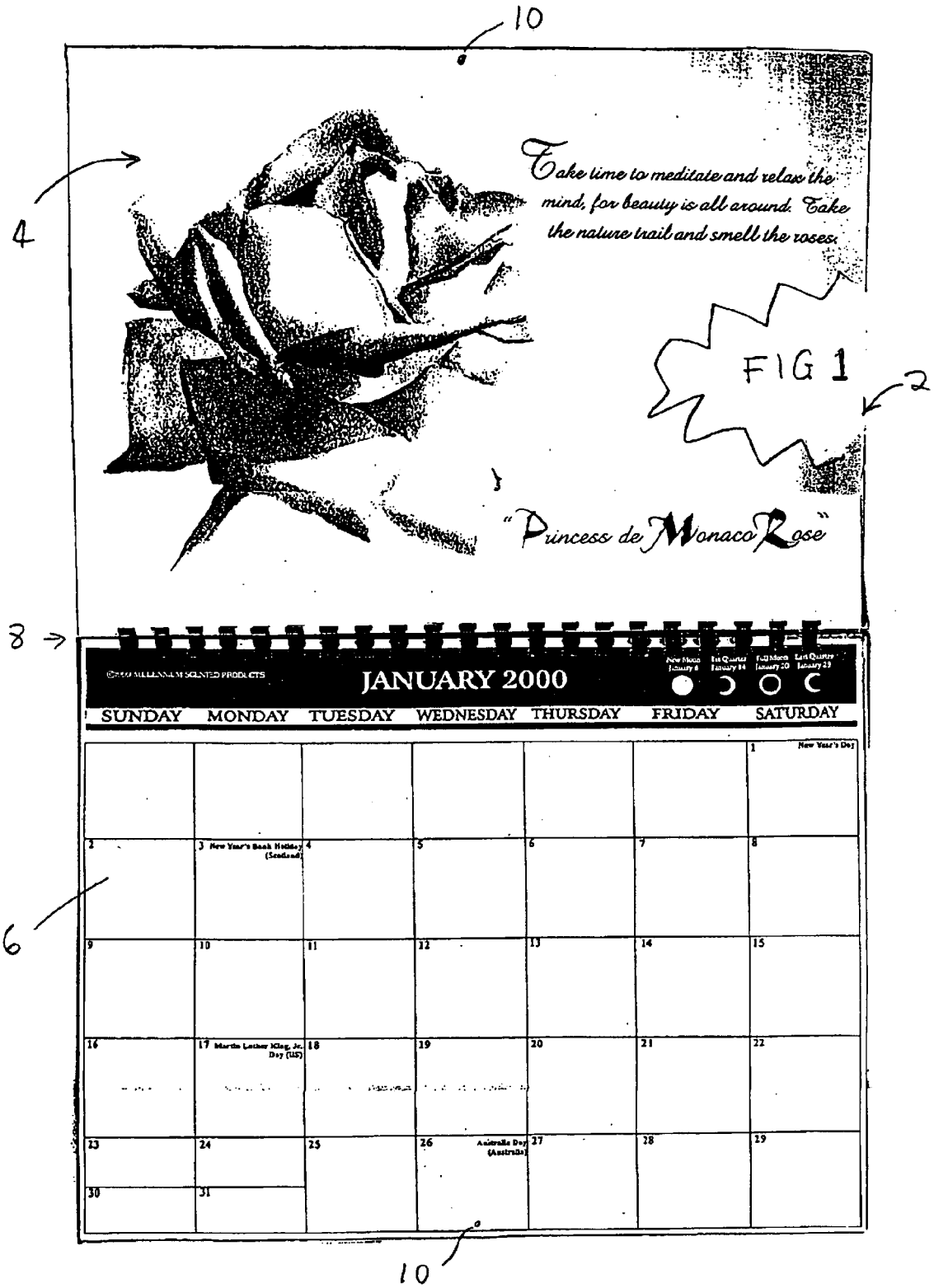
FIG. 1 is a plan view of one embodiment of the invention.

In the illustrated embodiments of the invention, there is shown a scented calendar. Preferably, the calendar is a monthly calendar, so that users will be reminded to replace or replenish the scent when the month is changed. However, the invention could also easily be provided in the form of a desk calendar as well. More preferably, especially in the case of the monthly calendar, the calendar depicts a new image each month, and the scent is associated with what the image depicts. For the purposes of explanation, however, only the month of January, 2000 is shown.

Many images are available which can be associated with available scents. For example, the monthly images could be of flowers with a corresponding flower scent.

For example, images of roses could be accompanied by rose scent. If desired, the scent could be different for each month. The images could be in the form of photographs, prints, photo lithographs, or other forms of artwork.

In a preferred embodiment, the scented calendar is in the form of a wall calendar 2 (see FIG. 1) and the description will proceed for this embodiment. The calendar 2 is formed by a plurality of sheets of paper each having an artwork image 4 on one face (see FIG. 2) and a monthly calendar image 6 on an opposite face. See FIG. 1.

The artwork image is oriented upside down with respect to the monthly calendar image on the opposite face so that flipping a face bearing a monthly calendar image upwardly about a horizontally disposed axis 8 reveals an artwork image positioned above a next following monthly calendar image, both in an upright orientation. Each sheet defines an aperture 10 adjacent a bottom edge of the calendar image and adjacent an upper edge of the artwork image to permit the calendar to be mounted to a wall hook or nail.

The horizontally disposed axis 8 is preferably formed by a spine element 12 (See FIG. 2) which is attached to the sheets of paper by ring elements 14. Other forms of binding, such as staples or a spiral binding, could also be used if desired.

Figure 5:
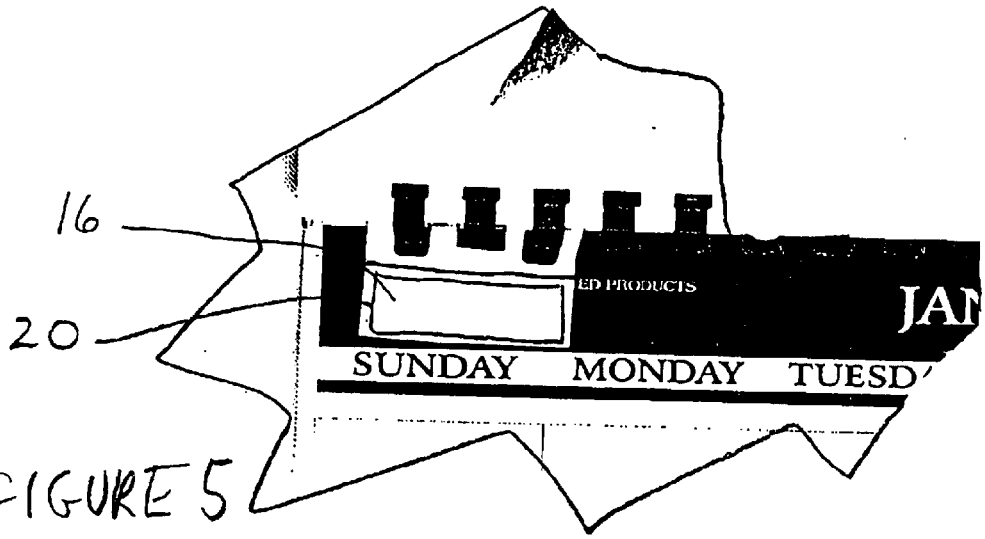
FIG. 5 is a plan view of a feature according to a further embodiment of the invention.
Figure 6:
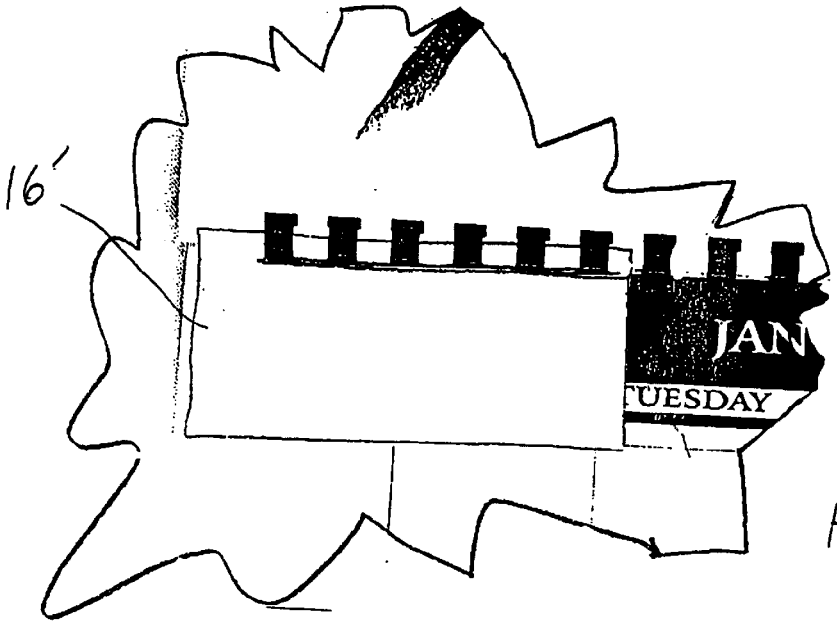
FIG. 6 is a plan view of a feature according to a further embodiment of the invention.
Figure 7:
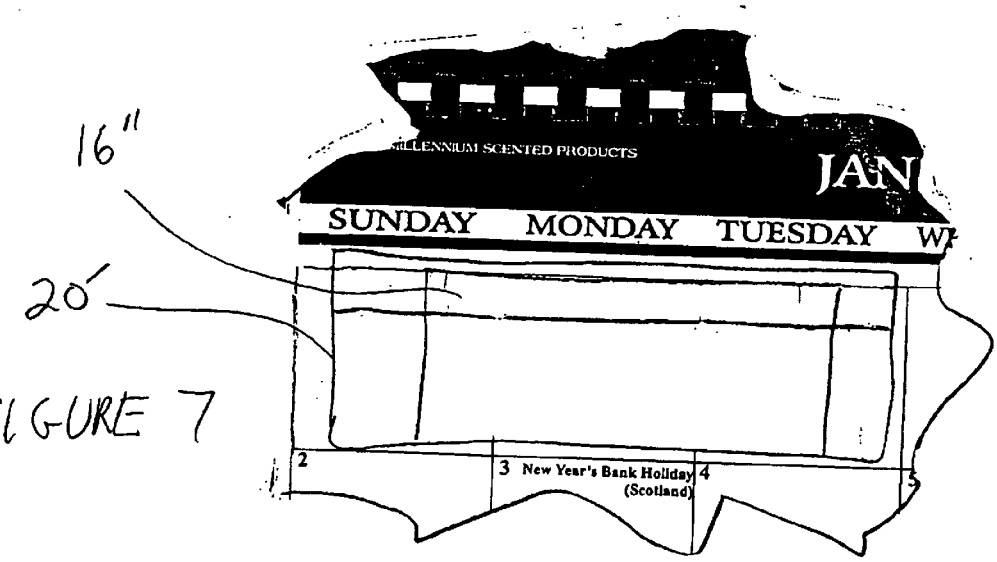
FIG. 7 is a plan view of a feature according to a further embodiment of the invention.

The invention preferably employs a scent element. FIG. 5 illustrates a scent element 16, FIG. 6 illustrates a scent element 16', and FIG. 7 illustrates a scent element 16". To better enable regular maintenance or replacement of the scent element, it is preferably positioned between an artwork image on a first sheet and a monthly calendar image on a following second sheet. See FIGS. 5, 6 and 7.

Figure 2:
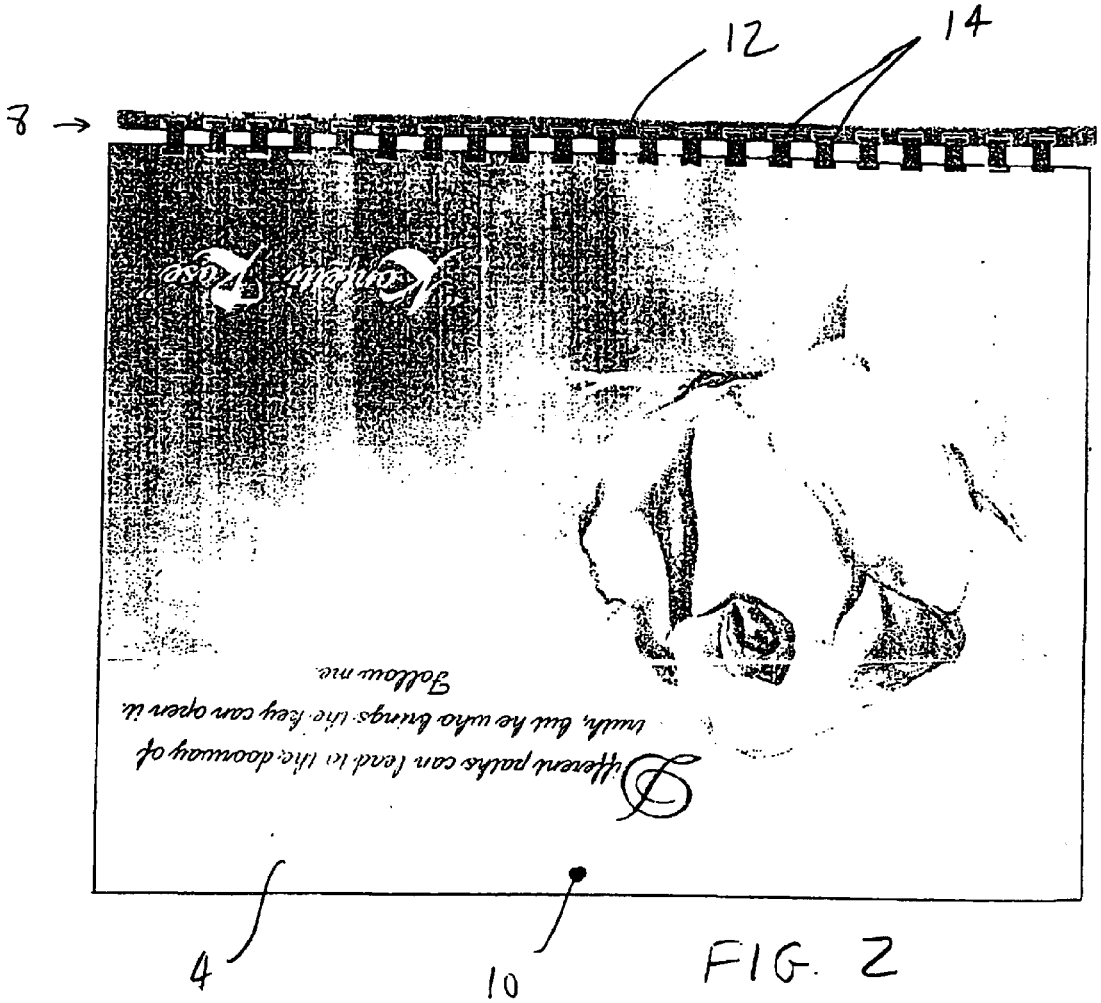
FIG. 2 is a reverse view of a lower portion of FIG. 1.

In the illustrations, the embodiment of the invention shown in FIG. 1 comprises a first sheet having the January artwork image 4' on one side, and a second sheet having a January calendar image 6 on one side and a February artwork image 4 on an opposite side. See FIG. 2. The first sheet and the second sheet are connected via the spine element 12 so that the January artwork image faces the January calendar image when the calendar is in a January-closed position and the January artwork image is positioned above the January monthly calendar image when the calendar is in a January open position. A scent element such as one of those shown in FIGS. 5, 6 or 7 is positioned between the January calendar image and the January artwork image when the calendar is in the January-open position and releases scent corresponding to the January artwork image.

Figure 4:
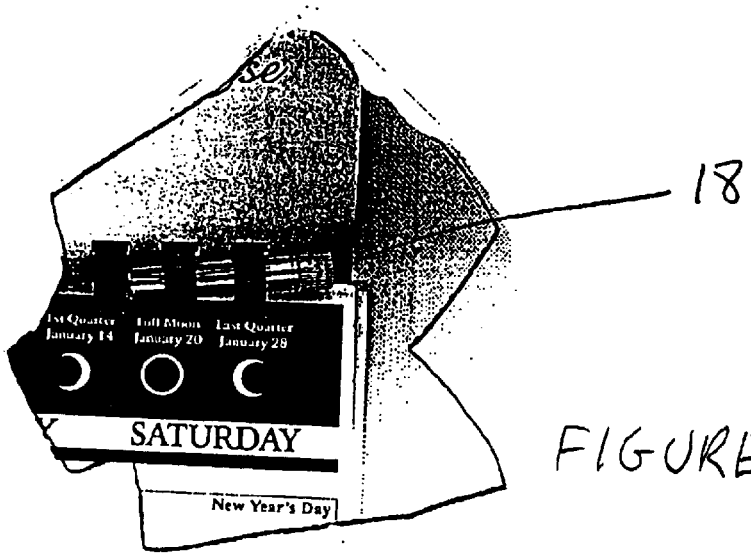
FIG. 4 is a plan view of a feature according to another embodiment of the invention.

The scent element can be formed from a wide range of materials. Absorbent materials such as paper or foamed materials are preferred. Blotting paper has been used in the construction of the scent element with good results. The blotting paper can be impregnated with a fragrant oil having the desired aroma to form the scent element. For example, for a rose aroma, the blotting paper can be impregnated with rose oil. If desired, a container of the fragrant oil can be supplied with or attached to the calendar to permit replen ishment of the scent element as desired. As illustrated in FIG. 4, the container is in the form of a vial 18 which is positioned inside of the ring elements which connect the spine 12 with the sheets of paper carrying the monthly calendar images. Where the scent element is carried by a plastic pocket, the oil can simply be injected into the pocket and permitted to wick into the blotting paper. FIG. 5 shows a pocket 20 which is attached to the spine of the calendar. FIG. 7 shows a pocket 20' which is attached to one of the sheets forming the calendar.

Figure 3:
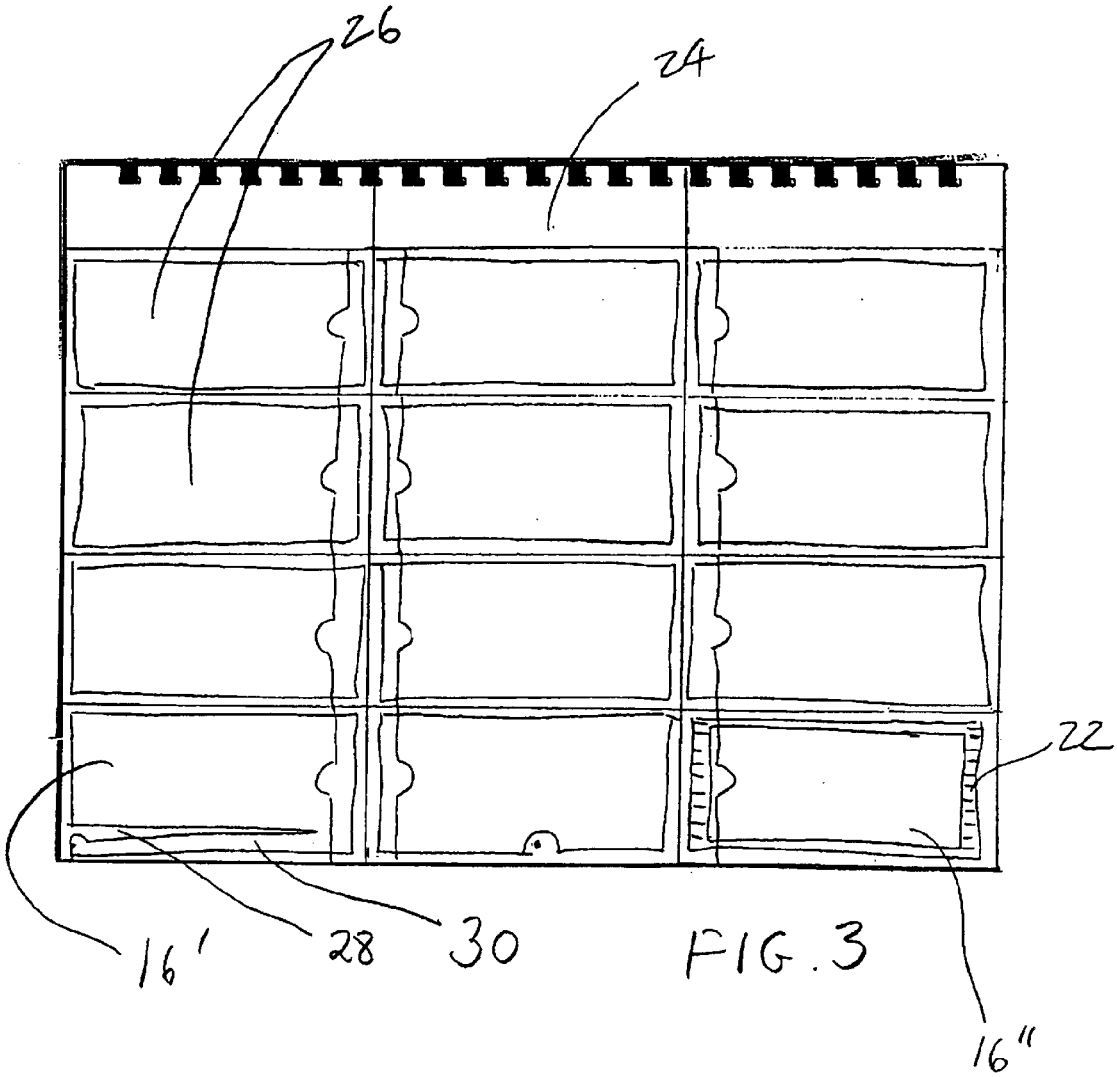
FIG. 3 is a plan view of another portion of the invention shown in FIG. 1.

If desired, the scent elements can be encased in a plastic wrapper for storage prior to use. In FIG. 3, a plastic wrapper 22 is shown encasing a scent element 16". The wrapper can be removed by the user to release the scent. The plastic wrapper can be attached directly to the spine, if desired.

FIG. 3 illustrates one way in which a plurality of scent elements can be provided for the annual calendar. A plastic sheet 24 which defines a plurality of pockets 26 is attached to the spine by the rings. Each pocket 26 carries a removable scent element. The sheet 24 would preferably be positioned after the December monthly calendar image. The scent elements would preferably be encased in plastic so that the dominant smell from the calendar would be associated with image of the open month.

In one embodiment of the invention, each removable scent element is configured to be attached to the calendar. In FIG. 3, a scent element 16' is formed from a card of blotting paper having a generally rectangular shape and a slot 28 extending alongside an edge surface of the card which is adjacent to the slot. A spear shaped protuberance 30 is formed between the slot and the adjacent edge surface which is configured so as to be received by the rings attaching the spine to the sheets. See FIG. 6.

While certain preferred embodiments of the invention have been described herein, the invention is not to be construed as so limited, except to the extent that such limitations are found in the claims.

What is claimed is:

1. A scented calendar having a container of a fragrant oil attached to the calendar to permit replenishment of a scent element attached to the calendar, the scented calendar comprising an annual calendar formed by a plurality of sheets of paper each having an artwork image on one face and a monthly calendar image on an opposite face, wherein the artwork image is oriented upside down with respect to the monthly calendar image on the opposite face so that flipping a face bearing a monthly calendar image upwardly about a horizontally disposed axis reveals an artwork image positioned above a next following monthly calendar image, both in an upright orientation, wherein each sheet defines an aperture adjacent a bottom edge of the calendar image and adjacent an upper edge of the artwork image to permit the calendar to be mounted to a wall hook or nail, said annual calendar further comprising a spine forming the horizontally disposed axis and including a first sheet having a January artwork image on one side; and a second sheet having a January calendar image on one side and a February artwork image on an opposite side, said first sheet and said second sheet being connected via the spine so that the January artwork image faces the January calendar image when the calendar is in a January-closed position and the January artwork image is positioned above the January calendar image when the calendar is in a January open position;

wherein the scent element which releases scent corresponding to the January artwork image is positioned between the January calendar image and the January artwork image when the calendar is in the January-open position, the scent element being formed from blotting paper which is impregnated with a fragrant oil having an aroma which corresponds to the January image.

2. A scented calendar as in claim 1, wherein the spine comprises a spine element attached to the sheets of paper by ring elements and the container is in the form of a vial which is positioned inside of the ring elements which connect the spine with the sheets of paper carrying the monthly calendar images, wherein the images are images of flowers.

3. A scented calendar as in claim 1 further comprising a plastic wrapper encasing the scent element which can be removed by the user to release the scent, wherein the images are images of flowers.

4. A scented calendar comprising an annual calendar formed by a plurality of sheets of paper each having an artwork image on one face and a monthly calendar image on an opposite face, wherein the artwork image is oriented upside down with respect to the monthly calendar image on the opposite face so that flipping a face bearing a monthly calendar image upwardly about a horizontally disposed axis reveals an artwork image positioned above a next following monthly calendar image, both in an upright orientation, wherein each sheet defines an aperture adjacent a bottom edge of the calendar image and adjacent an upper edge of the artwork image to permit the calendar to be mounted to a wall hook or nail, said annual calendar further comprising a spine forming the horizontally disposed axis and including a first sheet having a January artwork image on one side; and a second sheet having a January calendar image on one side and a February artwork image on an opposite side, said first sheet and said second sheet being connected via the spine so that the January artwork image faces the January calendar image when the calendar is in a January-closed position and the January artwork image is positioned above the January calendar image when the calendar is in a January open position;

said scented calendar further comprising a plastic sheet which defines a plurality of pockets attached to the spine, wherein each pocket carries a removable scent element which carries a scent.

5. A scented calendar as in claim 4 wherein wherein the artwork images comprise artwork of flowers and the scent carried by the calender comprises the scent of flowers, and each removable scent element is configured to be attached to the calendar.

6. A scented calendar as in claim 5 wherein the spine comprises a spine element attached to the sheets of paper by ring elements, and each removable scent element is formed from a card of blotting paper having a generally rectangular shape and a slot extending alongside an edge surface of the card which is adjacent to the slot, a spear shaped protuberance being formed between the slot and the adjacent edge surface which is configured so as to be received by the ring elements attaching the spine to the sheets.

7. A scented calendar as in claim 5 further comprising a plastic holder which defines a pocket for receiving a scent element and a fastener for attaching the plastic holder to the calendar is in a January-open position.

8. A scented calendar as in claim 7 wherein the scent element is sized for being received by the pocket, wherein the artwork images comprise artwork of roses, and the scent carried by the calender comprises the scent of roses.

* * * * *